US010183386B2

(12) United States Patent
Peterson et al.

(10) Patent No.: US 10,183,386 B2
(45) Date of Patent: Jan. 22, 2019

(54) BLIND HOLE PULLER WITH INTERCHANGEABLE ACTUATOR

(71) Applicants: Corday T. Peterson, Owatonna, MN (US); Erol Zeren, Eden Prairie, MN (US); Lonnie Bartsch, Geneva, MN (US)

(72) Inventors: Corday T. Peterson, Owatonna, MN (US); Erol Zeren, Eden Prairie, MN (US); Lonnie Bartsch, Geneva, MN (US)

(73) Assignees: Bosch Automotive Service Solutions Inc., Warren, MI (US); Robert Bosch GmbH, Stuttgart (DE)

( * ) Notice: Subject to any disclaimer, the term of this patent is extended or adjusted under 35 U.S.C. 154(b) by 335 days.

(21) Appl. No.: 14/872,301

(22) Filed: Oct. 1, 2015

(65) Prior Publication Data

US 2017/0095913 A1 Apr. 6, 2017

(51) Int. Cl.
*B25B 27/06* (2006.01)
*B25B 27/02* (2006.01)

(52) U.S. Cl.
CPC ..... *B25B 27/06* (2013.01); *B25B 27/02* (2013.01); *Y10T 29/53222* (2015.01)

(58) Field of Classification Search
CPC .... B25B 27/06; B25B 27/02; Y10T 29/53222
See application file for complete search history.

(56) References Cited

U.S. PATENT DOCUMENTS 7,980,604 B2 * 7/2011 Punaro ..... B25B 27/062 29/270

* cited by examiner

*Primary Examiner* — John C Hong
(74) *Attorney, Agent, or Firm* — Maginot Moore & Beck LLP

(57) ABSTRACT

A blind hole puller kit includes a plurality of different sized collets, a plurality of pins, an adapter, and a pulling device. The pins have differently sized first ends corresponding to the collets, and second ends that include a common mounting interface receivable in the adapter. A pin corresponding to a desired collet is configured to be mounted via it mounting interface into the adapter to form an actuating device. The actuating device, via an external thread of the adapter, is configured to be threaded into an internal thread of the collet to actuate tines of the collet to grip the inner surface of a hole to be pulled. An end of the adapter opposite the pin is configured to be mounted to the pulling device, whereby the pulling device can be operated to pull the hole.

17 Claims, 5 Drawing Sheets

BLIND HOLE PULLER WITH INTERCHANGEABLE ACTUATOR

TECHNICAL FIELD

This disclosure relates generally to mechanical tools, and, in particular, to blind hole pullers.

BACKGROUND

Blind hole pullers are tools that are used to remove elements like bearings and bushing from inside a larger assembly by grasping an internal diameter of the element and then pulling it out. As illustrated in FIG. 1, a blind hole puller 10 generally includes a collet 12, an actuator 14, and a pulling device 16. The collet 12 is connected to one end of the adapter 14 and is inserted into an opening of an element 15 such as a bearing or bushing to be pulled. The pulling device 16, in this case a slide hammer 16, is connected to an opposite side of the adapter 14 and is operated to pull the element 15.

FIG. 2 illustrates a blind hole pulling kit 20 that includes a plurality of adapters 14*a-d* and a plurality of collets 12*a-d* along with a slide hammer pulling device 16. A collet 12 is an expandable part that generally includes a plurality of tines 18 that together form a tube 20, and a separating device 22, such as a truncated cone, that gradually forces the tines 18 apart when pushed through the tube 20. An adapter 14 is generally a threaded part that, when threaded into the collet 12, forces the separating device 22 to move along the tube 20 in order to force the tines 18 apart. This motion causes an outer diameter of the tube 20 to expand. When this expansion occurs with the collet 12 inserted into an opening of the element 15, the outer diameter of the collet grasps the interior of the element.

When the collet is expanded within the element, the pulling device 16 is affixed to an end 24 of the adapter 14 opposite the collet 12 (FIG. 1). While the pulling device 16 in FIGS. 1 and 2 is a slide hammer, other types of pulling devices are acceptable, such as bridges and the like. The pulling device 16 is then operated to generate a pulling force outwards from the hole or opening in which the element 15 is received. Because the tines 18 are grasping an interior diameter of the element to be removed, the element is pulled out from the hole or opening.

As illustrated in FIG. 2, collets 12*a-d* are available in a variety of sizes in order to pull holes of various dimensions, and actuators 14*a-d* are respectively sized to match with a corresponding collet 12*a-d*. In order to maintain durability and operability, the collets 12*a-d* and adapters 14*a-d* are generally machined within tight tolerances of each other. However, since each size collet 12*a-d* requires a correspondingly sized adapter 14*a-d*, the material required, machining needed, and costs for a blind hole puller kit 20 rises for each size collet 12*a-d* to be included in the kit 20. Additionally, the collets 12*a-d* and actuators 14*a-d* are subjected to significant wear during use, which can limit their operational lifespan.

Therefore, what is needed is a blind hole puller with reduced material and machining needs, and with an increased durability and operational lifespan

SUMMARY

In order to facilitate the pulling of blind holes, a blind hole puller kit that exhibits increased durability and operational lifespan and that facilitates production with a reduced amount of machining and material includes a plurality of different sized collets, a plurality of pins, and an adapter.

Each collet defines a differently sized opening. A first end of each pin defines a common mounting interface for the adapter, and a second end of each pin is sized to correspond to the opening of one of the collets. Each pin is configured to actuate the corresponding collet as the second end of the pin is inserted into the opening of the collet. The adapter includes a receiving interface that is configured to receive the mounting interface common to the first ends of the pins.

When a pin is received in the adapter, the pin and adapter together form an actuating device for the corresponding collet. The actuating device is operable to actuate the collet in order to grasp an interior of a hole to be pulled. An end of the adapter opposite the pin defines a mount for affixing a pulling device such as a slide hammer or bridge to the actuation device. When affixed to the actuation device, the pulling device is operable to apply a pulling force to the collet in order to pull the blind hole.

This summary is intended only to introduce subject matter which is discussed in more detail in the detailed description, the drawings, and the claims, and is not intended to limit the scope of this disclosure in any way.

BRIEF DESCRIPTION OF THE DRAWINGS

The foregoing aspects and other features of the present disclosure are explained in the following description, taken in connection with the accompanying drawings.

DETAILED DESCRIPTION

Figure 1:
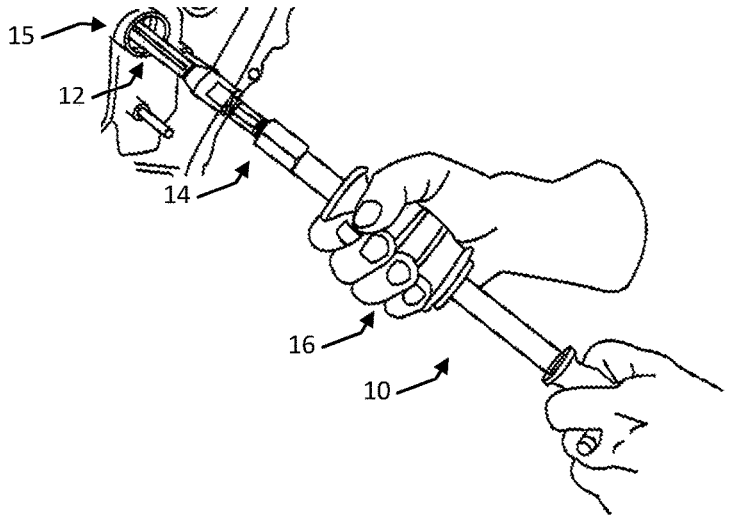
Fig. 1 (Prior Art)
FIG. 1 is an illustration of a known blind hole puller being used to pull a blind hole.

For a general understanding of the present embodiments, reference is made to the drawings. In the drawings, like reference numerals have been used throughout to designate like elements.

Figure 3:
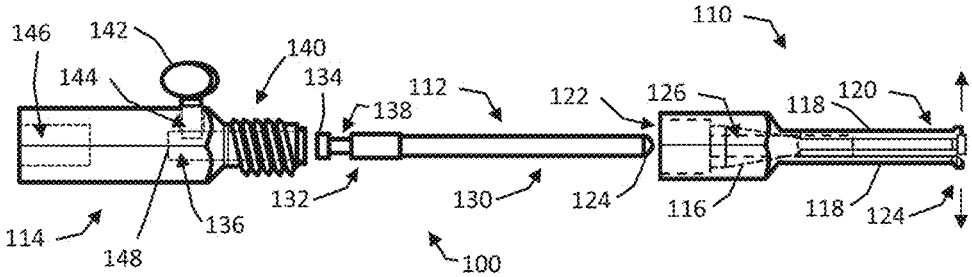
FIG. 3 is a side view of a disassembled blind hole puller according to this disclosure.

FIG. 3 illustrates a blind hole puller 100 according to this disclosure. The puller 100 includes a collet 110, a pin 112, and an adapter 114.

The collet 110 can be any acceptable type or size of collet that is usable for blind hole pulling. In this embodiment, the collet 110 includes a separation device 116 and tines 118 forming a tube 120, and defines a first receiving area 122 which forms an axial opening.

The separation device 116 is configured to slide at least partially into the tube 120, and has a shape of a truncated cone, such that the separation device 116 is configured to force the tines 118 apart as the separation device 116 slides toward an end 124 of the tube 120. A natural resilience of the tines 118 acts to move the tines 118 toward the resting positon illustrated in FIG. 3, which also causes the tines 118 to act to move the separation device 116 away from the end 124 until the cone of the separation device 116 is not engaged with the tines 118. In some embodiments, the collet can additionally include a return spring (not shown) that acts on the tines in the direction of the resting position.

The separation device 116 defines a second receiving area 126 that is configured to receive a first end 128 of the pin 112 such that the separation device 116 is moved with the pin 112 as the pin 112 moves toward the end 124 of the tube 120.

The pin 112 has a first portion 130 and a second portion 132. The first portion 130 includes the first end 128, and is sized to be received within the second receiving area 126 of the device 116. In order to maintain contact between the pin 112 and the collet 110, the first portion 130 is advantageously sized for a close running fit within the second receiving area 126 of the separation device 116.

The second portion 132 includes a second end 134 of the pin 112 opposite the first end 128. The second portion 132 is configured to be received within a third receiving area 136 of the actuator 114, and also defines a locking region 138 in a region between the second end 134 and the first portion 130.

The adapter 114 includes an external thread portion 140 and a locking member 142, and, in addition to defining the third receiving area 136, further defines a fourth receiving area 144 and fifth receiving area 146.

The third receiving area 136 is configured to receive the second portion 132 of the pin 112. In order to maintain contact between the pin 112 and the collet adapter 114, the third receiving area 136 is advantageously sized for a close running fit with the second portion 132 of the pin 112. The third receiving area 136 also defines a stop surface 148 that delimits an extent to which the pin 112 can be inserted therein.

The fourth receiving area 144 extends transversely to and intersects with the third receiving area 136, and is located such that the locking region 138 is accessible via the fourth receiving area 144 when the second end 134 of the pin is in abutment with the stop surface 148. The locking member 142 is configured to pass through the fourth receiving area 144 in order to engage the locking region 138 of the pin.

Figure 4:
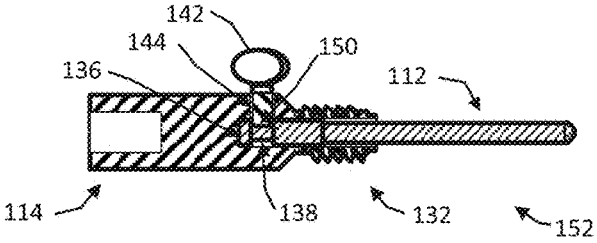
FIG. 4 is a cross-section view of an assembled actuating device of the blind hole puller of FIG. 3.

FIG. 4 illustrates a cross-sectional view of the adapter 114, where the pin 112 is locked within the adapter 114 so that the pin 112 and adapter 114 together form an actuating device 152. As illustrated in FIG. 4, when the locking member 142 is engaged with the locking region 138, the pin 112 is held captive within the adapter 114.

In this embodiment, the locking member 142 may be a thumb screw, and the locking region may be defined by a circumferential notch in the second portion 132 of the pin 112. The thumbscrew includes an external thread, and the fourth receiving area 144 defines an internal thread configured to receive the external thread of the thumb screw. When the thumbscrew is screwed so that a least a portion 150 of the thumbscrew passes into the third receiving area 136 such that the portion 150 is configured to axially bear against the notch of the pin 112 to restrain axial motion of the pin 112 within the third receiving area 136. Other types of acceptable locking mechanisms are also contemplated. In one embodiment, the locking member 142 is a set screw. In other embodiments, a locking mechanism for locking the pin 112 to the adapter 114 includes a snap, a spring, a magnet, or any other acceptable locking device.

Additionally, the structure of the second portion 132 of the pin 112 is configured to hold the pin 112 in an axial position relative to the adapter 114. Regions of the second portion 132 of the pin 112 on each axial side of the locking region 138 are in contact with the interior of the third receiving region 136 and thus hold the pin 112 in an axial orientation within the third receiving area 136.

Figure 5:
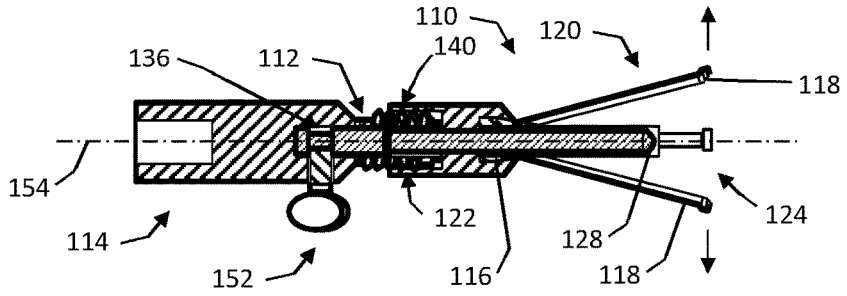
FIG. 5 is a cross section view of the blind hole puller of FIG. 3 in an assembled and actuated state.

FIG. 5 illustrates the actuating device 152, namely the adapter 114 with the pin 112 locked therein, and inserted into the collet 110. The external thread portion 140 surrounds at least a portion of the third receiving area 136 and is configured to be received by the first receiving area 122 of the collet 110, which includes an internal thread configured to engage the external thread portion 140. By threading the external thread portion 140 into the first receiving area 122 of the collet 110, the first end 128 of the pin 112 is forced toward the end 124 of the tube 120. This motion causes the separating device 116 to move toward the end 124 of the tube and actuate the tines 118, causing the diameter of the tube 120 to expand at the end 124, as shown in FIG. 5.

Figure 6A:
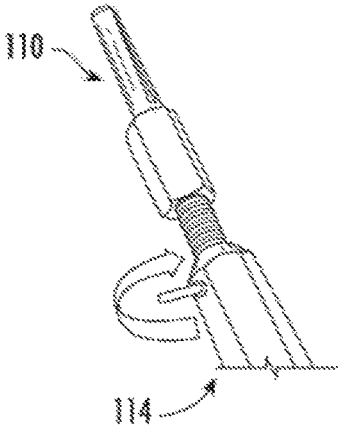
FIGS. 6A and 6B are images of a user actuating a blind hole puller according to this disclosure.
Figure 6B:
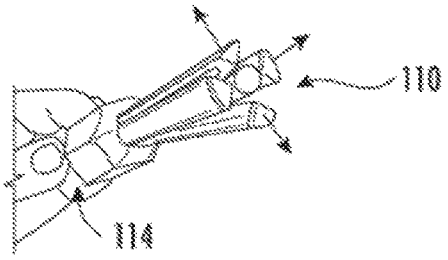

To thread the external portion 140 into the first receiving area 122, the adapter 114 and collet 110 are rotated relative to each other about the longitudinal axis 154. This rotation can be executed by a user by gripping the adapter 114 and collet 110 in each hand respectively and rotating one relative to the other. However, tool-assisted threading is also contemplated. FIGS. 6*a* and 6*b* are images respectively before and after a user manually twists a collet 110 relative to the adapter 114 in order to expand the collet 110 from the position shown in FIG. 6A to the position shown in FIG. 6B.

Figure 7:
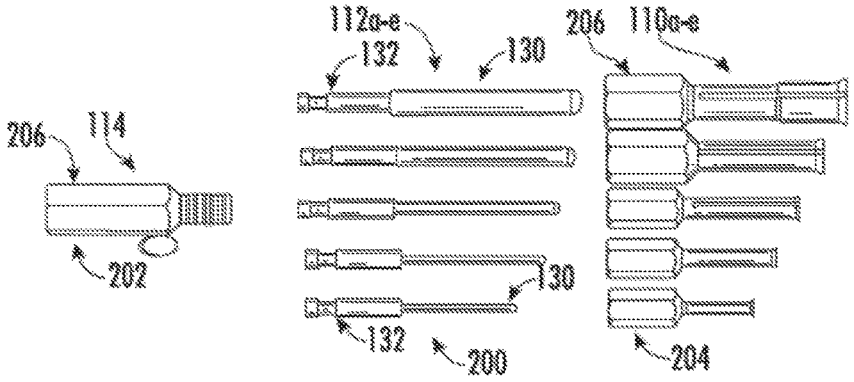
FIGS. 7-9 are images of different blind hole pulling kits according to this disclosure.

FIG. 7 illustrate a blind hole pulling kit 200 that includes a plurality of collets 110*a-e*, a plurality of pins 112*a-e*, and a common adapter 114. In this embodiment, at least a portion 202 of the adapter 114 and a portion 204 of the collets 110*a-e* have a hexagonal outer shape 206. The hexagonal outer shape 206 enables the adapter 114 and/or the collet 110*a-e* to be gripped by, for example, a vice, a wrench, or the like to facilitate the threading of the adapter 114 into the collet 110*a-e*. Other outer shapes that facilitate gripping are also contemplated.

Figure 8:
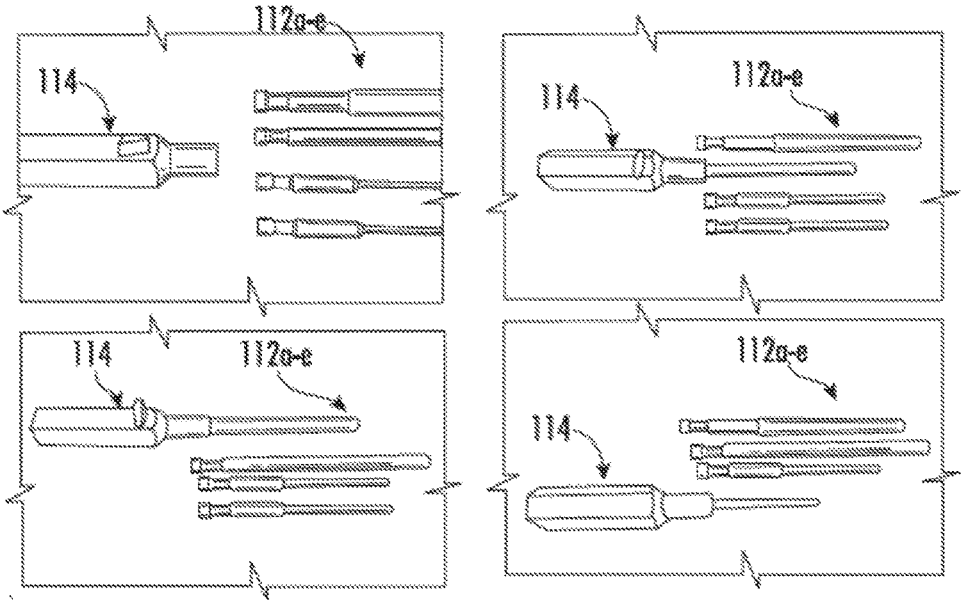

Each pin 112*a-e* has a first portion 130 configured with a different size matched to a corresponding collet 110*a-e*. However, the second portions 132 of the pins 112*a-e* are of the same configuration, and thus define a common mounting interface that is configured to be received in the common adapter 114. Thus, the single adapter 114 can be used for pulling a variety of sizes of holes by installing a pin 112*a-e* that is sized for the collet 110*a-e* configured to pull the hole. FIG. 8 illustrates images depicting an adapter 114 alternatingly mounting different pins 112*a-d* via the common mounting interface.

Figure 2:
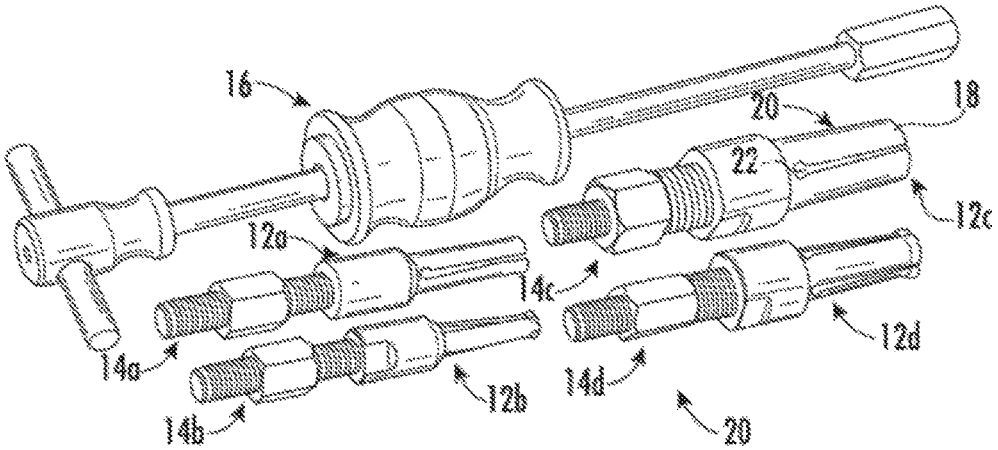
Fig. 2 (Prior Art)
FIG. 2 is a perspective image of a known blind hole pulling kit.

To produce a conventional blind hole pulling kit, as illustrated in FIGS. 1 and 2, where each size collet is matched to an actuating device of a corresponding size, each collet and actuating device are preferably precisely machined so that the interface therebetween complies with the close running fit needed for efficient operation. If each actuator does not have a close running fit with its corresponding collet, the collet may warp, bind, or jam during operation, and may be difficult to remove from the collet at the end of the operation. The machining needed to produce the precise running fit increases the cost and complexity of the production for each size collet to be included in the kit. Including an adapter for each collet also increases the amount of material needed to produce the kit.

In the blind hole pulling kit 200 according to this disclosure, rather than separately machining different actuating devices that each have different sizes as in the prior art, only a single adapter 114 need be produced that can form differently sized actuating devices by being combined with differently sized pins 112*a-e*. While the pins 112*a-e* are sized to correspond to the common adapter 114 on one end and different sizes of collets 110*a-e* on the other, the shape of the pins 112*a-e* is relatively simple, and facilitates a fast and straightforward production. The pins 112*a-e* do not include any threaded surfaces or complex operational elements, and can be produced by an acceptable production process known in the art.

During operation, components of the blind hole puller kit 200 (FIG. 7) may be subjected to intense forces, heat, and strain. In one embodiment, at least one of the adapter 114, pin 112, and collet 110 is formed, at least in part, from a heat treated steel. In one embodiment, at least a portion of at least one of the adapter 114, pin 112, and collet 110 is formed from a 4041 steel alloy.

The action of the pin 112 reduces strain acting between the collet 110 and adapter 114 relative to the strain between a conventional collet and actuator. The pin 112 is free to rotate within the adapter 114 and collet 110, and furthermore acts as a stress intermediary therebetween. A blind hole puller according to this disclosure thus exhibits increased durability and has an increased operational lifespan relative to conventional hole pullers.

Figure 9:
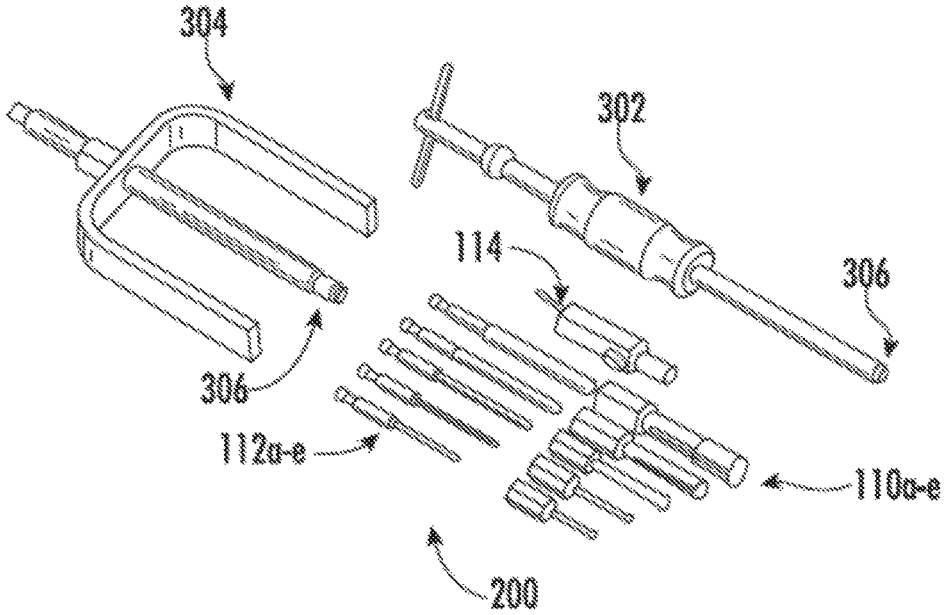
Figure 10:
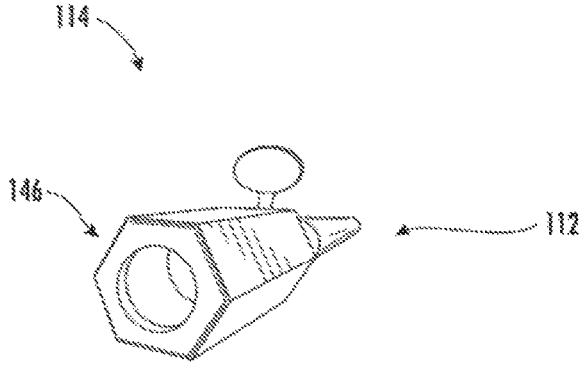
FIG. 10 is an image of the mounting end of an adapter for a blind hole puller according to this disclosure.

FIG. 9 illustrates an exemplary embodiment of a blind hole puller kit 300 that includes a slide hammer 302 and a bridge 304 in addition to the collets 110*a-e*, pins 112*a-e*, and adapter 114 discussed above. As illustrated in FIG. 9, the slide hammer 302 and the bridge 304 each have an end 306 that defines a common mounting interface configured to be received in the fifth receiving area 146 of the adapter 114 (FIG. 3). Other pulling devices having the common mounting interface are also contemplated. The common mounting interface allows the adapter 114, pines 112*a-e*, and collets 110*a-e* to be used with a variety of pulling devices for a variety of operations. FIG. 10 is a perspective image of the adapter 114. In this embodiment the fifth receiving area 146 is a threaded hole that extends axially from a side of the adapter 114 opposite the pin 112.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A blind hole puller system, comprising:

a plurality of differently sized collets, each collet defining a differently sized longitudinal opening and having an end opposite the longitudinal opening that is configured to expand to engage an inner surface of a blind hole;

a plurality of first members that each include a first end defining a commonly configured mounting interface and a second end opposite the first end, the second ends of the first members differently sized to correspond to the differently sized opening of the collets, such that each first member is configured to actuate a corresponding collet as the second end of the first member is inserted into the opening of the corresponding collet; and a second member that includes a receiving interface configured to receive the commonly configured mounting interface of the plurality of first members, such that the second member is configured to form differently sized actuators configured to actuate the differently sized collets by receiving differently sized first members corresponding to the differently sized collets.

2. The system of claim 1, further comprising at least one of:

a slide hammer; and a bridge;

wherein the second member defines a mounting end opposite the receiving interface that is configured to be mounted in the at least one of the slide hammer and the bridge.

3. The system of claim 1, further comprising a locking member, wherein:

the receiving interface of the second member defines:

a first hole configured to receive the commonly configured mounting interface of the plurality of first members; and a second hole transverse to and intersecting the first hole;

the commonly configured mounting interface of the plurality of first members defines a notch located such that the notch is accessible via the second hole when the first end of the commonly configured mounting interface is received in the first hole of the second member; and the locking member is configured to lock the commonly configured mounting interface to the second member when the locking member is passed through the second hole so as to be at least partially received in the notch of the commonly configured mounting interface.

4. The system of claim 3, wherein the second hole defines an inner thread, and the locking member is a thumbscrew or set screw having an external thread configured to be received in the internal thread.

5. The system of claim 3, wherein the lock between the commonly configured mounting interface together with the second member is configured to prevent each first member from remaining in the opening of the corresponding collet when the second member is removed.

6. The system of claim 1, wherein:

each of the plurality of collets defines a commonly configured internal thread extending axially around the opening; and the second member defines an external thread surrounding the receiving interface that is configured to be received in the commonly configured internal thread of the openings of the plurality of collets, such that each first member, when received in the receiving interface of the second member, is configured to actuate the corresponding collet as the external thread of the second member is threaded onto the commonly configured internal thread of the corresponding collet.

7. The system of claim 6, wherein:

an outer geometry of the commonly configured internal thread is configured to be gripped by a first gripping tool; and an outer geometry of at least a portion of the second member beyond the external thread is configured to be gripped by a second gripping tool.

8. The system of claim 1, wherein at least one of the plurality of collets, the plurality of first members, and the second member includes heat-treated steel.

9. A blind hole pulling device, comprising:

an adapter that includes:

a receiving interface that is configured to receive a commonly configured mounting interface of pins usable to actuate differently sized collets, the receiving interface defining:

a first hole configured to receive the commonly configured mounting interface; and a second hole transverse to and intersecting the first hole;

an external thread surrounding the first hole and configured to be received in a commonly configured internal thread of collets usable to pull differently sized elements, the external thread configured such that a pin received in the first hole is introduced through the commonly configured internal thread as the external thread is threaded therein; and a mounting end opposite the receiving interface that is configured to be mounted to a commonly configured pulling device interface; and a locking member configured to be received in the second hole in order to engage a notch of the commonly configured mounting interface to lock the commonly configured mounting interface within the adapter.

10. The device of claim 9, wherein the second hole defines an inner thread, and the locking member is a thumbscrew or set screw having an external thread configured to be received in the internal thread.

11. The device of claim 9, wherein an outer geometry of at least a portion of the adapter beyond the external thread is configured to be gripped by a gripping tool usable to thread the adapter onto the commonly configured internal thread.

12. The device of claim 11, wherein the outer geometry is defined by a hexagonal prism.

13. The device of claim 9, wherein that adapter includes heat-treated steel.

14. The device of claim 9, further comprising at least one collet with the commonly configured internal thread that defines a longitudinal opening extending therethrough, and that includes:

an end opposite the longitudinal opening that is configured to expand to engage an inner surface of an element to be pulled, an expanded diameter of the end corresponding with an inner diameter of the element to be pulled; and a separating device that is longitudinally movable within the at least one collet, and that is configured to expand the end as the separating device is moved toward the end.

15. The device of claim 14, further comprising at least one pin usable to actuate the at least one collet;

the at least one pin having:

a first end with the commonly configured mounting interface; and a second end opposite the first end that is configured to engage the separating device such that, when the first end is received in the receiving interface of the adapter, the second end of the at least one pin moves the separating device of the at least one collet toward the end of the at least one collet to actuate the at least one collet as the external thread of the adapter is threaded into the commonly configured internal thread of the at least one collet.

16. A method of operating a blind hole pulling device, comprising:

inserting an operational end of a collet into an element to be pulled, the collet sized to correspond to an inner surface of the element;

mounting a pin that has a first end sized to correspond with a longitudinal opening in the collet in a receiving interface of an adapter via a mounting interface on a second end of the pin opposite the first end to form an actuating device, wherein the receiving interface of the adapter is configured to receive a commonly configured mounting interface of pins usable to actuate differently sized collets, the mounting interface of the pin is configured in conformance with the commonly configured mounting interface, the receiving interface of the adapter defines:

a first hole configured to receive the commonly configured mounting interface; and a second hole transverse to and intersecting the first hole, the adapter additionally includes:

an external thread surrounding the first hole and configured to be received in a commonly configured internal thread of collets usable to pull differently sized elements, the external thread configured such that a pin received in the first hole is introduced through the commonly configured internal thread as the external thread is threaded therein; and a mounting end opposite the receiving interface that is configured to be mounted to a commonly configured pulling device interface; and mounting the pin in the receiving interface of the adapter includes inserting the second end of the pin into the first hole of the adapter such that a notch defined by the commonly configured mounting interface of the pin is accessible via the second hole in the adapter;

passing a locking member through the second hole such that the locking member is at least partially received by the notch in order to lock the pin to the adapter;

inserting the first end of the pin into the opening of the collet to engage the actuating device with the collet; and threading an external thread of the adapter that surrounds the receiving interface onto an internal thread of the collet that axially extends from the opening in order to cause the actuating device to actuate the collet.

17. The method of claim 16, further comprising:

mounting an end of the adapter opposite the receiving interface into a slide hammer or bridge; and operating the slide hammer or bridge in order to pull the hole.

* * * * *